United States Patent [19]

Babinsky et al.

[11] 4,219,394

[45] Aug. 26, 1980

[54] MEMBRANE ASSEMBLY FOR ELECTROLYTIC CELLS

[75] Inventors: Andrew D. Babinsky, Chagrin Falls; Charles J. Hora, Painesville; Edward J. Peters, Chardon; Wayne P. Zeman, Richmond Heights, all of Ohio

[73] Assignee: Diamond Shamrock Corporation, Dallas, Tex.

[21] Appl. No.: 889,026

[22] Filed: Mar. 22, 1978

Related U.S. Application Data

[63] Continuation-in-part of Ser. No. 774,800, Mar. 7, 1977, abandoned.

[51] Int. Cl.[2] ..... C25B 1/16; C25B 1/26; C25B 9/00; C25B 13/02

[52] U.S. Cl. ..... 204/98; 204/128; 204/258; 204/296

[58] Field of Search ..... 204/98, 128, 296, 252–266

[56] References Cited

U.S. PATENT DOCUMENTS

| | | | |
|---|---|---|---|
| 3,072,545 | 1/1963 | Juda et al. | 204/257 |
| 3,287,250 | 11/1966 | Brown et al. | 204/263 |
| 3,634,213 | 1/1972 | Coates | 204/252 |
| 4,025,405 | 5/1977 | Dotson et al. | 204/98 |

OTHER PUBLICATIONS

"Electroforming" by Spiro, 2nd Ed., 1971, p. 23.

*Primary Examiner*—R. L. Andrews
*Attorney, Agent, or Firm*—John P. Hazzard

[57] ABSTRACT

In an electrolytic cell of the membrane type wherein the anolyte and catholyte are separated by a hydraulically impermeable membrane, the improvement comprising limiting the hydraulically impermeable membrane portion of the divider between anolyte and catholyte chambers to that area which is between the active areas of the anode and cathode while all other areas between catholyte and anolyte chambers are nonpermeable so as to minimize back-migration of undesirable ions which decrease overall current efficiency. Specifically, in a chlor-alkali cell an electrode would be enclosed in a fluorinated ethylene propylene enclosure having window-like openings therein made from Nafion type hydraulically impermeable cation exchange membrane, said window-like openings exposing only active electrode areas.

10 Claims, 5 Drawing Figures

MEMBRANE ASSEMBLY FOR ELECTROLYTIC CELLS

RELATED APPLICATIONS

This application is a continuation-in-part of U.S. application Ser. No. 774,800, filed Mar. 7, 1977, now abandoned.

BACKGROUND OF THE INVENTION

In commercial practice, as for example in the chlor-alkali industry, diaphragm type electrolytic cells have been most common until recent years. In these diaphragm type cells the diaphragms separated the anolyte and catholyte chambers. Normally, these diaphragms were simply an asbestos mat or the like and in any case were hydraulically permeable. Normal practice was to build such an asbestos diaphragm between opposed anodes and cathodes so that the diaphragm extended therebetween to the walls of the cell or to clamping means at the wall surfaces. Another arrangement common in the prior art was to have the diaphragm material to entirely surround the cathode and in fact be deposited on the cathode so as to cover all surfaces thereof. In all cases however, the anolyte, due to the hydraulic permeability of the diaphragm would be essentially in contact with all surfaces of the cathode whether they be active or inactive.

This same practice has been carried over into electrolytic cells employing hydraulically impermeable membranes between anolyte and catholyte chambers. Standard practice has been to place a membrane wall between anode and cathode to eliminate hydraulic communication between each chamber. Of necessity, such use of a sheet membrane covered both active and inactive areas between the electrodes.

Furthermore, in membrane cells wherein a single cathode forms a cell with two anodes the practice has been to enclose the cathode in a hydraulically impermeable membrane envelope wherein the membrane prevented liquid communication with the cathode in the electrolytic cell. Such an envelope was open only at the top above the liquid level to allow the escape of gases formed during electrolysis. Here again, all areas of the cathode were covered without discrimination between active and inactive surfaces. Such complete enclosure of the cathode with a hydraulically impermeable membrane is detrimental for a number of reasons. For example, consider such a membrane completely enclosing the cathode in a chlor-alkali cell. Between the inactive regions of the cathode and membrane there will be caustic. However, since there will be little electrolysis occurring in these areas, a significant amount of back-migration of hydroxyl ion would occur which would result in a serious loss in cell current efficiency.

Also, the membrane material is more expensive compared to a nonpermeable material such as used in the instant invention to separate the anolyte and catholyte chamber in inactive electrode areas.

Another advantage of the instant invention over the prior are practices is that fabrication of a membrane envelope is extremely difficult and in any event more difficult than fabricating an envelope of nonpermeable material with membrane windows. Due to its relatively delicate nature, membranes are more difficult to fabricate especially in cases where you are attempting to form an envelope which would completely surround an electrode. The potential leakage problems would exist wherever the membrane was joined to itself and especially in areas of stress such as along edges when the membrane is shaped at great angles to closely fit the cathode shape.

The advantages of the instant invention are further magnified when it is considered that most commercial electrolytic operations consist of a large plurality of individual electrolytic cells wherein the use of impermeable envelopes having hydraulically permeable membrane windows therein between active areas of the electrodes are used. Such envelopes can be interconnected and preferably are as for example, when a multicell diaphragm type operation is converted to a membrane type unit.

BRIEF DESCRIPTION OF THE INVENTION

In its broadest sense, the instant invention comprises limiting the hydraulically impermeable membrane dividing the anolyte and catholyte chamber in an electrolytic cell to that area between the electrodes which is more active electrolytically while separating the anolyte and catholyte chamber in inactive electrode areas with a nonpermeable material which is sealed to or coated on the membrane separator.

In membrane type chlor-alkali cells a hydraulically impermeable membrane made of such materials as Nafion completely separate the anolyte and catholyte chambers. In the simplest case where there is a single anode and a single cathode, the membrane of the instant invention would consist of a flat Nafion sheet conforming to the shape and size of the active portion of the electrodes. This sheet of Nafion would be fixedly attached to a frame of impermeable material which would extend to the sides and bottom of the cell so as to completely separate the anolyte and catholyte chambers. The nonpermeable framing material would preferably be a material such as fluorinated ethylene propylene sheet which would eliminate back migration of hydroxyl ions from the catholyte chamber in the inactive areas between the anolyte and catholyte chambers, thus increasing cell current efficiency accordingly while minimizing membrane costs due to lesser use of Nafion in a given cell.

In more complex arrangements such as where a single cathode interacts with a plurality of anodes, the present invention would envisage an impermeable envelope surrounding the cathode with hydraulically impermeable membrane windows therein conforming to the size and shape of the electrodes and positioned between the active areas of the interacting cathode and anodes. Normally, in actual practice a plurality of such envelopes would be interconnected and would be open at the top to allow chlorine gas to escape from the anolyte portion of the cell for collection, while the envelopes would form a closed chamber over the cathodes so as to keep the hydrogen generated at the cathodes separated from the chlorine and have such hydrogen withdrawn from the side of the commercial cell.

In addition, such a plurality of envelopes may be shaped so as to interact with the sidewalls and/or bottom of the cell to effect proper alignment. For example, the envelopes could contain protrusions which fit into apertures on the cell bottom or cell walls or in fact holes could extend through the bottom of the envelopes and the anodes could protrude there through into positioning slots in the cell bottom while at the same time sealing the membrane around the hole in the lower end of the envelopes.

DETAILED DESCRIPTION OF THE INVENTION

Figure 1:
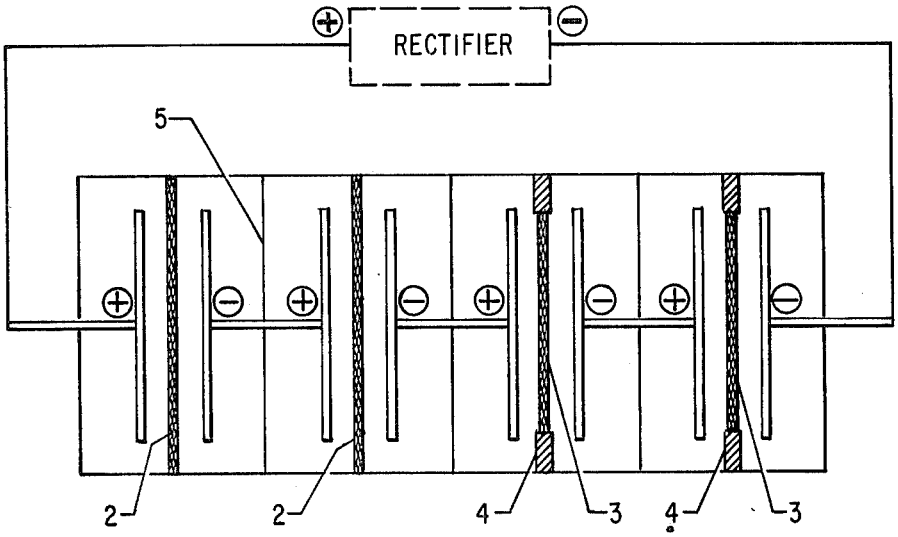
FIG. 1 of the drawings illustrates the instant invention in its simplest form in the two cells at the right of the drawing as opposed to the standard prior art practice illustrated by the two cells on the left hand side.

In a chlor-alkali cell of the membrane type, an electrolyzing current is passed between an anode and a cathode, the two being separated by a permselective ionic membrane. Chlorine gas is generated at the anode, and water is reduced to hydroxide and hydrogen gas at the cathode. The bulk of the current is carried by sodium ions which pass from the anode compartment to the cathode compartment wherein they form along with the hydroxide produced at the cathode aqueous sodium hydroxide or caustic. Some of the current used in the cell is carried by hydroxide ions as they travel from the cathode to the anode compartment due to both ordinary diffusion and electro-static migration. This back migration of hydroxide is the major source of cell inefficiency. Once the hydroxide has passed through the membrane into the anode compartment, the hydroxide can react with the chlorine gas to form hypochlorite or chlorate. When these side reactions occur, it is obvious that not all of the current is being utilized for the production of caustic and chlorine. And in fact, impurities are generated in such systems. The formation of chlorate is highly undesirable because of its corrosive nature.

As stated earlier, the overall current efficiency of a cell (in the current state of the art) is mainly affected by the back migration of hydroxyl ions through ordinary diffusion and electro-static migration through the membrane. The electro-static migration occurs through the membrane in the active region between the interacting anode and cathode and is minimized as will be discussed in more detail later in the specification by modifying the membrane so as to minimize such back migration. Ordinary diffusion of hydroxyl ion from the cathode compartment through the membrane into the anode compartment can occur at any point in the membrane. Thus, it is a primary intent of the instant invention to eliminate the use of membrane at all points between the anode and cathode chambers except between the active areas of the electrodes. By active area of an electrode is meant that surface area of a given electrode which would be in unobstructed straight line visual communication with any portion of an interacting electrode of opposite polarity when the membrane separator is removed. Thus, the membrane separator would be limited in dimension to essentially that area between interacting electrodes intersected by said imaginary unobstructed straight lines between interacting electrodes in the plane in which the membrane is placed, said area being referred to as the active electrode zone. The remainder of the area between the compartments would be made up of a nonpermeable material which would be capable of withstanding the cell environment.

While this description is centered on chlor-alkali membrane type cells, the inventive concept herein disclosed is applicable to any electrolytic process employing a membrane separator between anode and cathode compartments wherein back migration is detrimental to over all cell current efficiency.

The particular type of membrane utilized in the chlor-alkali cells of the present invention or other electrolytic processes to which the instant invention is applicable could be any of those known to those skilled in the art. However, the preferred membranes of the instant invention are generally derived from (i.e. result from the saponification of) any fluorinated polymer having pendant side chains bearing sulfonyl groups attached to carbon atoms, on each of which carbon atoms there is at least one fluorine atom. Such fluorinated polymers are prepared from monomers that are fluorinated or fluorine-substituted vinyl compounds. They are made from at least two monomers with at least one of the monomers coming from each of the groups (1) fluorinated vinyl compounds, such as vinyl fluoride, hexafluoropropylene, vinylidene fluoride, trifluoroethylene, chlorotrifluoroethylene, perfluoro (alkyl vinyl ether), tetrafluoroethylene, and mixtures thereof and (2) a sulfonyl containing monomer containing the precursor—$SO_2F$. Exemplary are $CF_2{=}CFSO_2F$ and, generically, $CF_2{=}CFY_fSO_2F$, wherein $Y_f$ is a bifunctional perfluorinated radical containing from 2 to 8 carbon atoms. More preferably the hydraulically impermeable cation exchange membranes are those copolymers having the repeating structural units:

$$-CF_2-\underset{\underset{\underset{SO_3H}{|}}{(R)_n}}{\underset{|}{CF}}-$$

and $-CF_2-Cxx^1$ wherein x is fluorine, chlorine or trifluoromethyl; and $x^1$ is x or $F(FC_2)_a$—O— wherein a is an integer from 1 to 6.

In the copolymer there should be sufficient repeating units according to the last mentioned formulas above, to provide an —$SO_3H$ equivalent weight of about 800–1600. Although lower and higher equivalent weights can be used also. Materials having a water absorption rate of about 25% or greater are preferred since higher cell potentials at any given current density are required for materials having less water absorption. Similarly, materials having a film thickness of about 8 mils or more require higher cell potentials resulting in a lower power efficiency.

Polymeric materials of this preferred type are further described in the following patents which are hereby incorporated by reference U.S. Pat. Nos. 3,041,317; 3,282,875; 3,560,568; 3,624,053; 3,718,627; 3,969,285; and British Pat. No. 1,184,321. Polymeric materials as described are available from E. I. duPont deNemours & Company under their trademark NAFION.

The nonpermeable portion of the divider between the anode and cathode compartments contemplated by the instant invention can be any nonconductive or impermeable material that can withstand the environment of the particular electrolytic cell in which it is utilized. Typically, such impermeable materials as polyvinylchloride, hard rubber, titanium or the like could be used. The only criteria for selecting the impermeable material is first that it is indeed impermeable and can be fixedly attached to the membrane sufficiently to have an economic life expectancy. Preferably, the impermeable portion of the cell divider would be made up of FEP or PFA type Teflon manufactured by E. I. duPont deNemours and Company which can be shaped in the desired manner by methods known to those skilled in the molding arts. When using the preferred impermeable Teflon materials (hereinafter referred to as FEP and PFA), it should be pointed out that an unsaponified Nafion membrane must be used in order to effect a good heat sealed joint so as to form a strong leak-free bond that holds up well during cell operation. By unsaponified Nafion membrane is meant one in which the sulfonyl fluoride groups on the polymer have not yet been converted to the alkali metal form.

Likewise, should it be desired to use a surface treated Nafion type membrane wherein the sulfonyl fluoride groups of the Nafion type membrane are reacted with ammonia gas, an amine, polyamine, or mixtures thereof, such surface treatment of the Nafion type membranes should be done subsequent to the heat sealing of the membrane to the FEP impermeable portion of the divider between the anode and the cathode compartments.

In the simplest form, the present invention could consist of a single cell having one anode and one cathode being separated from the anode compartment by a liquid impermeable plastic sheet. At the active electrode areas, the plastic would be cut out and replaced with a permselective membrane which would be heat sealed to the plastic sheet. Alternatively, the membrane material could extend from cell wall to cell wall and all areas of said membrane not in the active electrode zone would be coated with any nonpermeable material which prevents hydroxyl ion passage and can withstand the cell environment. FIG. 1 illustrates this concept in a four cell bipolar unit 1. While this is illustrated as a bipolar electrolytic cell, it could be rearranged without departing from the scope of the instant invention to a monopolar unit. By monopolar unit is meant one in which each cell is separate with all anodes commonly connected and all cathodes separately commonly connected. In any event, the first two cells shown in FIG. 1 separate the anodes and cathodes thereof with a permselective membrane 2. The membrane 2 extends all the way to the cell walls and bottom of unit 1 and is intended to indicate the normal practice envisioned in the prior art. The last two individual cells in unit 1 include permselective membranes 3 which are framed by an impermeable membrane 4, said impermeable member effects a seal with the membrane so as to completely isolate the anode and cathode compartments hydraulically and also covers all of the inactive electrode area between the compartments. As illustrated, each individual cell in unit 1 is isolated by walls 5 between each successive cell.

Figure 1A:
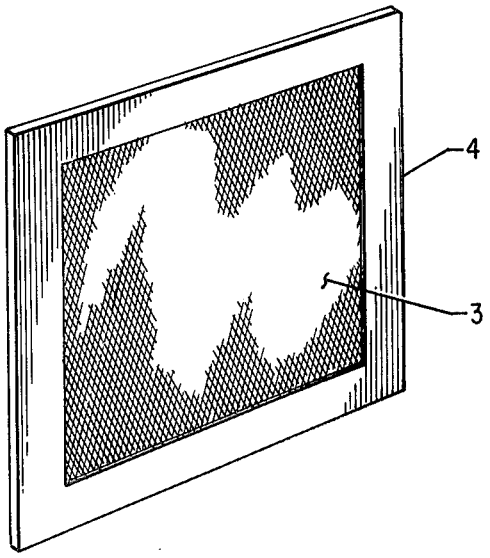
FIG. 1*a* is an illustration of a membrane divider framed with nonpermeable material such as utilized in the two right hand cells of FIG. 1.

FIG. 1*a* more clearly illustrates the divider used in the last two cells of FIG. 1 to divide the anode and cathode compartments with the permselective membrane window 3 conforming to the size and shape or active electrode zone between the cell compartments surrounded and sealed to an impermeable member 4.

Figure 2:
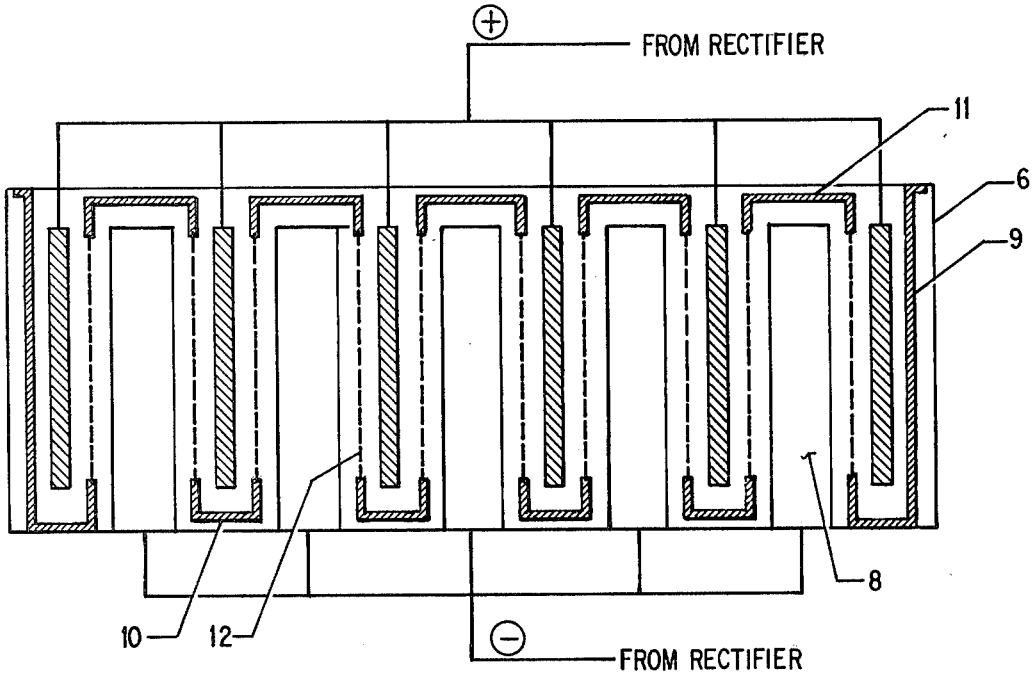
FIG. 2 is an illustration of a typical commercial cell wherein a single cathode interacts with two anodes in cross section through the active areas of the electrodes.
Figure 2A:
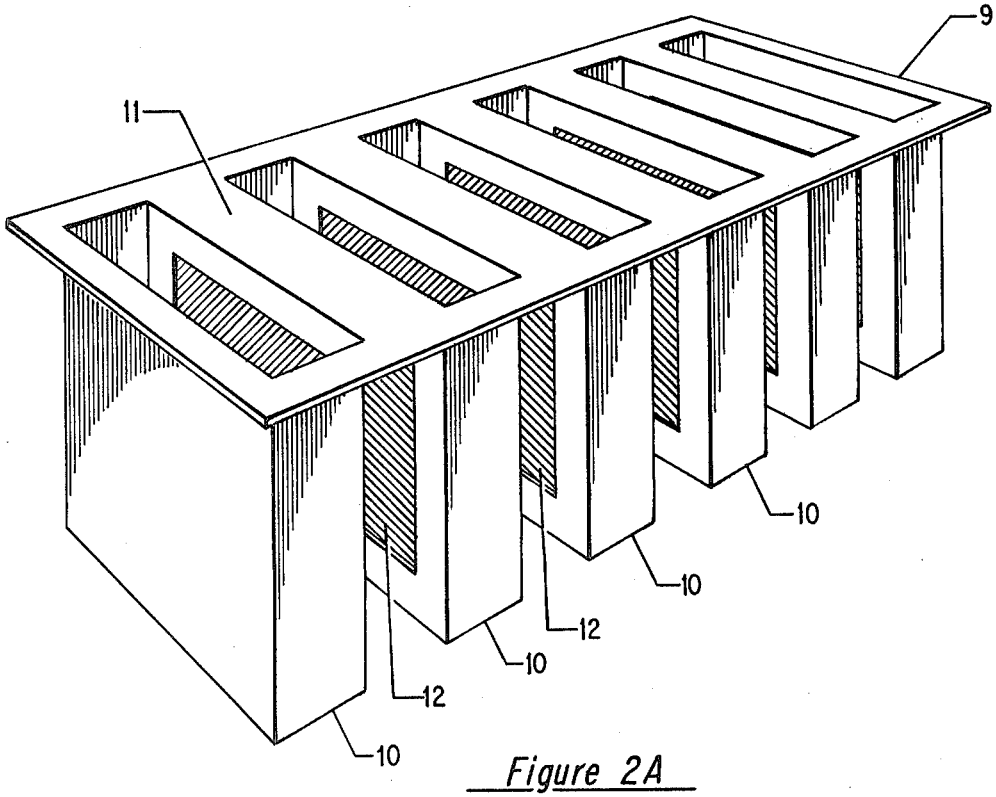
FIG. 2*a* illustrates the plurality of envelopes with membrane windows therein in the active area of the electrodes such as illustrated in FIG. 2.

FIG. 2 illustrates another form of the invention and is intended to show a more commercial form of the instant invention in a monopolar electrolytic unit 6. Basically, unit 6 consists of a series of six vertically arranged anodes 7 with vertically disposed cathodes 8 between each pair of anodes 7. The cathode compartments of such a chlor-alkali unit 6 are hydraulically isolated from the anode compartments by a separator 9 best illustrated in FIG. 2*a*. Referring to FIG. 2*a*, separator 9 is primarily constructed of impermeable material and preferably fluorinated ethylene propylene polymer and generally consists of envelopes 10 which are open topped box-like members which surround each anode. The tops of each envelope 10 are interconnected by a generally flat upper surface 11 which extends out beyond envelopes 10 in all directions so as to form a lip which is used to effect a seal with the cell walls to as to completely hydraulically isolate all the cathode chambers from the anode chambers of unit 6. In separator 9 in the areas which lie between active areas of electrodes, windows 12 consist of permselective membrane, preferably of the Nafion type. As in other variations of the instant invention, these window-like membranes are fixedly attached, preferably by heat sealing, to the impermeable portion of separator 9.

When using the illustrated constructions of FIGS. 2 and 2*a* as a chlor-alkali cell, the separator 9 is open above anodes 7 so as to permit brine circulation and chlorine gas release. Separator 9 is closed above the cathodes which forces the hydrogen and caustic formed at the cathode to be collected through openings in the side of unit 9 or in the alternative separate openings could be cut through upper surface 11 (not shown) with the appropriate associated hardware to withdraw either the caustic or hydrogen formed at the cathodes.

FIG. 2 is also illustrative of a great many commercial diaphragm type chlor-alkali units. Of course when such a unit is a diaphragm unit, separator 9 would be removed and each cathode would be coated with an asbestos diaphragm. Thus, the particular design illustrated in FIGS. 2 and 2*a* for separator 9 represents one permitting easy conversion from diaphragm to membrane cell operation with only minor changes in the cell hardware. The particular dimensions and shape of the liner can be modified to fit any given cell design.

As can be seen from the structure of separator 9, it can be easily prefabricated for quick conversion of an operating commercial chlor-alkali cell of the diaphragm type to the membrane type with essentially the only changes required would be to install a modified method of removing the hydrogen gas generated at the cathodes.

As has been stated earlier, the preferred permselective membrane is a cation exchange resin sold under the trade name Nafion. The surface of the Nafion may be treated with ammonia gas, amines (both primary, secondary and polyamines) or mixtures thereof. Such surface treatment improves the membranes resistance to back migration of hydroxide through the membrane. Among the more effective surface treatments for this purpose is to surface treat with ethylene diamine prior to saponification of the membrane. Such surface treatment, however, further embrittles a somewhat delicate material from which the membrane is made which further obviates the improvement of the instant invention.

If the separators as shown in FIGS. 2 and 2*a* were constructed entirely of such membrane material, it would lead to quick failure in operation, if indeed one could be formulated which would remain hydraulically impermeable, since the embrittlement would undoubtedly cause ruptures to occur where the membrane made sharp angle bends or has to be stretched in the formation of the separator. Such deficiencies in an all membrane separator cannot be improved by using a thicker membrane material or by utilizing membrane with heavy reinforcing therein because both would be detrimental to the operation of the cell and in themselves affect deterioration of the membrane and loss of current efficiency. On the other hand, the membrane separators of the instant invention are all essentially flat sheets which is the shape in which they were formed and no further stresses need be applied to them in fabrication of the separator other than to affect the heat seal between the membrane windows and the surrounding impermeable FEP structure.

The Nafion type membrane when used in the practice of the instant invention is usually of a thickness of 1–10 mils and can be fabric backed. Thinner membranes can be utilized but fabrication and handling is naturally more difficult. Membranes thicker than 10 mils likewise can be used but are detrimental from a current efficiency standpoint. The FEP plastic portion of the separators of the instant invention can be of any thickness which can be conveniently utilized in the particular cell configuration in which it will be used. Normally however, an FEP plastic of approximately the thickness of the membrane is sufficient but preferably would be in the 5–15 mil range. Of course, thicker FEP membranes could be utilized and in fact such could be designed to contain raised portions thereon which would help position the anodes and cathodes with respect to the desired cell geometry.

The FEP plastic or other impermeable material from which the majority of the separator would be made can be formed by any conventional molding techniques. It is preferred that complex shapes such as shown in FIG. 2 that the FEP be formed by vacuum molding. But of course other methods can be used to achieve the same result. In normal practice, a complete FEP separator would be formed as by vacuum molding. Thereafter, windows would be cut into the FEP separator which would correspond to the active areas between electrodes when properly placed in an electrolytic cell. The desired Nafion sheet material would then be cut to the size and shape of the active area of the related electrodes and be heat sealed to the FEP separator so as to close the window which has been either cut in the FEP separator or formed therein during molding. We have found that it is sufficient to use a ¼" overlap of membrane around the window to affect a good seal with the FEP which will result in long and continuous operation when placed in a chlor-alkali electrolytic cell.

Nafion type membrane in its final saponified form is completely inert chemically and cannot be bonded, glued, sewn, or mechanically fastened in any simple way. In the acid form, the membrane has already incorporated water into its structure and thus could not be heat sealed conveniently. Thus, in order to affect a good heat seal between Nafion and the impermeable portion of the cell divider, Nafion in the sulfonyl fluoride form should be used. In the sulfonyl fluoride form, the Nafion is still thermoplastic with good heat bonding properties. Also, the sulfonyl fluoride form of Nafion is anhydrous and is the only form of the Nafion which is suitable for heat sealing and, indeed, the only state of the polymer which may be used for the instant purposes. In this form, Nafion may be sealed to itself or to FEP type Teflon. After heat sealing the sulfonyl fluoride form membrane, the membrane is subsequently hydrolyzed in strong base to its final operating saponified form. If it is desired to modify the membrane surface with ammonia gas, amines, polyamines, or mixtures thereof, such modification is affected subsequent to heat sealing the Nafion membrane window in place and prior to acidification and/or saponification thereof.

The heat sealing step itself must be accomplished at a temperature sufficient to melt the materials used in constructing the cell separators. When Nafion—FEP cell separators are fabricated, the required temperature to affect the proper heat seal is between 600–640° F. Care should be taken to limit the heating to the areas where the seal is desired only. Heat sinks are preferably used to eliminate overheating surrounding areas of membrane or FEP. Typical heat sinks could be aluminum sheet material in contact with the membrane and FEP adjacent the surfaces to be sealed. Another specific means to protect areas adjacent the heat seals which have been found to be most effective, is to place 0.005 inch titanium shim stock over areas to be protected and this serves to conduct the heat rapidly away from those areas resulting in no heat seal or damage beneath the metal.

The heat seals are best obtained by placing the materials to be heat sealed between opposed heated platens which both apply the heat to the area to be sealed and supply the slight pressure required to affect a good seal. With respect to pressure, any pressure can be used so long as it is not excessive so as to result in extruding melted membrane and/or FEP from between the opposed platens.

In commercial practice for a monopolar cell, the cell separator has to fit very snugly over the cathode assembly so that proper gasketing and sealing can be accomplished. For this reason, close dimensional control over the assembly must be maintained. Membranes of the Nafion type expand and contract rather greatly as they are changed through their various forms. Fortunately, however, these expansions and contractions of the membrane from initial to final form tend to cancel each other out to a great degree and for most purposes can be ignored. Thus, the preferred technique is simply to size the assembly with sulfonyl fluoride form membrane and fabricate. The membrane expands somewhat on saponification, expands a little more upon conversion to the acid form, and then shrinks back to approximately original dimensions upon conversion to the sodium form during operation.

The best mode contemplated by the inventors for carrying out this invention is to first fabricate the FEP cell separator having a window between the active portions of the electrodes. The FEP separator should preferably be approximately 10 mil thickness. A Nafion window which is preferably 7 mil, T-12 reinforced is cut to fit the window and to overlap the window on all sides by approximately ¼". Opposed heated platens are made to contact the overlapped area of the FEP and membrane and the overlapped portion is heated to a temperature in the range of 620–630° F. while maintaining a slight pressure with the opposed platens. The opposed heated platens are preferably Teflon coated to prevent sticking to the seals. However, if sticking is a problem, a thin sheet of KAPTON polyimide film (approximately 0.003 inch thickness) can be placed between the materials to be sealed and the platen to effectively keep the platen from sticking to the sealing portions of the cell separator.

After cooling, the seals are now complete and the side of the membrane facing the cathode can now be modified by treatment with ammonia gas, amines, polyamines, or mixtures thereof by methods known in the prior art prior to saponification of the membrane.

The saponification of the completed assembly consists of taking the membrane assembly in the sulfonyl fluoride form in the surface modified form and immersing same in a solution of 60% dimethylsulfoxide, 40% water, and 13% by weight KOH or NaOH at a temperature of 80–90° C. for approximately 2 hours. The assembly is then removed, rinsed with distilled water, and soaked in dilute hydrochloric acid (about 5%) at 50–60° C. until ready for use. This procedure assures the presence of ionic species within the membrane so that an easy start-up is achieved.

The sealing of backed or fabric reinforced membrane to itself is made more reliable by the use of lengths of ½" wide sulfonyl fluoride form Nafion film. By placing such a strip of Nafion film between the backed reinforced side of the membrane window and the adjacent reinforced membrane, improved contact is obtained between the backed membranes being joined and a better bond is accomplished since the sandwiched strip of Nafion film can flow to fill gaps and voids caused by the reinforcing fabric. This procedure is not necessary when bonding FEP or unbacked film to fabric reinfoced film since the flow properties of these materials under heat and pressure are adequate to insure good seals in and of themselves.

Another aspect of the instant invention is that it now enables the construction of a monopolar type chlor-alkali cell of the membrane type which for the first time can be commercially operational while utilizing a less capital intensive design than is required by the currently existing bipolar chlor-alkali cells. In addition to the easy replacement of electrodes in the monopolar arrangement, simplified gas take off means can be employed which result in appreciable capital investment savings.

Operation of the electrolytic cells contemplated by the instant invention are at their normal current density, temperature and catholyte and anolyte concentrations. Typically, in a chlor-alkali cell the current density would range from 1 to 3 ASI at a cell operating temperature of approximately 90–95° C. With respect to concentrations of anolyte and catholyte, it is preferred that the anolyte be a saturated brine solution and the catholyte contain approximately 520–560 grams per liter caustic.

Figure 3:
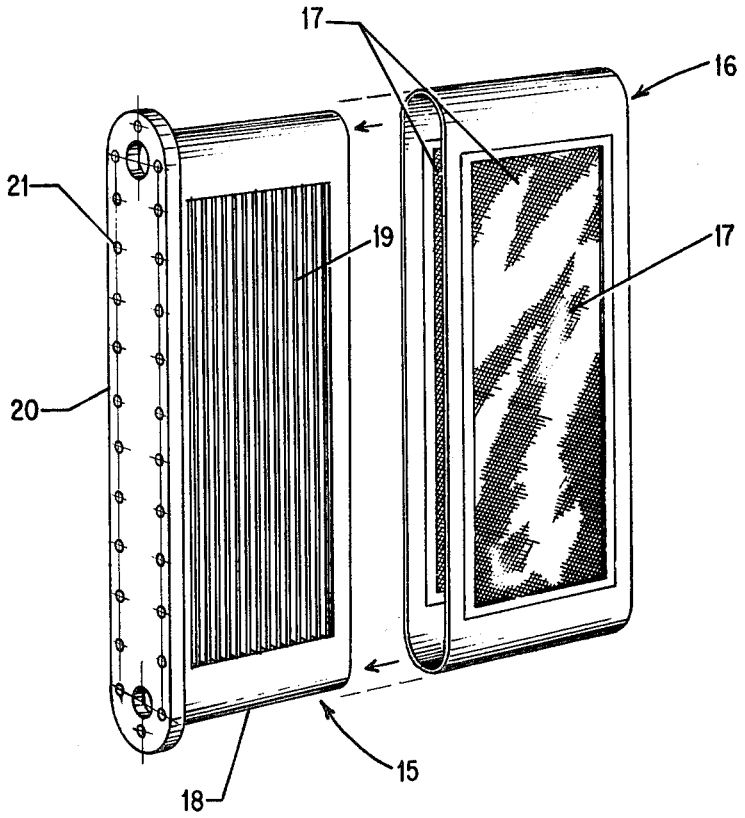
FIG. 3 illustrates another form of the invention similar to that of FIG. 2 wherein a single cathode interacts with adjacent anodes utilizing a membrane window between active areas of the electrodes.

FIG. 3 is another embodiment of the instant invention. Here is shown a cathode 15 which is intended to be operational between two related anodes not shown. An FEP form 16 is shaped like the cathode 15 and is designed to slide over the cathode completely enclosing the same. FEP form 16 has Nafion windows 17 on both sides of the FEP form which have been heat sealed thereto and are sized and shaped to conform to the active area of the electrodes. The particular design illustrated in FIG. 3 consisted of a steel cathode body 18 connected to parallel nickel plates in the active cathode area 19. The FEP form 16 after being slid over the cathode is sealed therein by gasketing.

The cathode 15 is attached to a cathode plate 20 containing bolt holes 21 which are used to bolt the cathode into the cell.

Such a cathode as shown in FIG. 3 was utilized in the following example.

EXAMPLE

A rubber lined steel cell body was fabricated containing two anodes with an intermediate cathode. The anodes were conventional dimensionally stable anodes, i.e., titanium mesh with a Beer coating. The active area of the anodes measured 6" by 1" by 24". The cathode was constructed as shown in FIG. 3. It consisted of a steel body with 0.06" wide nickel parallel plates. The parallel plates had an area of 6" by 24" on each side and were separated by approximately ¼". The separator was constructed from 10 mil FEP and two pieces of unsaponified Nafion permselective ionic membrane measuring 6" by 24". The membrane was sealed to the FEP separator by pressing the same together and heating them to a temperature of 620–630° F. After heat sealing the unsaponified Nafion windows to the FEP separator, the membrane was saponified by contacting it for one hour with a dimethylsulfoxide caustic solution at 95° C. followed by a one hour treatment with 5% HCl at 90° C. After assembly of the cell, the membrane area went through its "break in" period by being operated at 1 ASI for 3 days. During this break in period, the voltage ranged from 3.42 to 3.53 volts at a cell temperature of 80° C. and at caustic concentrations of 460–470 grams per liter. The above constructed cell with a ¼" anode to cathode electrode gap was operated for 42 straight days at 2 ASI (approximately 550 amps) and no major difficulties were encountered and the separator remained leak tight throughout. Cell temperatures during the run leveled out at 88° C. with cell voltages of 4.30–4.40 volts. The routine current efficiency ranged from 71–75% at caustic concentrations of 510–540 grams per liter. The membrane used in this example was a 7 mil T-12 fabric reinforced 1200 equivalent weight Nafion membrane and the FEP had a thickness of 10 mils.

We claim:

1. A method of improving current efficiency in a chlor-alkali cell of the membrane type which comprises limiting back-migration of hydroxyl ions through the membrane divider by limiting the membrane portion of the divider to a size and shape conforming to substantially the active electrode zones between interacting electrodes, said membrane portion of the divider being positioned substantially directly between said interacting electrodes in said active electrode zones and having the remaining portion of the divider being impervious to hydroxyl back-migration.

2. The method of claim 1 wherein the membrane portion of the divider between anolyte and catholyte chambers is a fluorinated polymer containing pendant side chains containing sulfonyl groups which are attached to carbon atoms which have at least one fluorine atom attached thereto and the nonpermeable portion of the divider is fluorinated ethylene propylene or perfluoroalkoxy modified polytetrafluoroethylene.

3. In a chlor-alkali electrolytic cell of the membrane type wherein the anolyte and catholyte are separated by a hydraulically impermeable membrane, the improvement comprising limiting the hydraulically impermeable membrane portion of the divider between anolyte and catholyte chambers to the active electrode zones while all other areas of the divider are nonpermeable so as to minimize back-migration of undesirable ions and maximize current efficiency.

4. The electrolytic cell of claim 3 wherein the membrane portion of the divider between anolyte and catholyte chambers is a fluorinated polymer containing pendant side chains containing sulfonyl groups which are attached to carbon atoms which have at least one fluorine atom attached thereto and the nonpermeable portion of the divider is fluorinated ethylene propylene or perfluoroalkoxy modified polytetrafluoroethylene.

5. In a chlor-alkali electrolytic cell wherein one or more cathodes each interact electrolytically with a plurality of anodes and wherein anolyte and catholyte chambers are separated by a hydraulically impervious divider, the improvement comprising a divider shaped to closely fit each such cathode made from an impervious, nonconductive material having windows therein consisting of hydraulically impervious membrane, said membrane windows being of a size and shape conforming to substantially the area of the active electrode zones of said interacting electrodes and said membrane windows being positioned substantially directly between said interacting electrodes.

6. The electrolytic cell of claim 5 wherein the membrane portion of the divider between anolyte and catholyte chambers is a fluorinated polymer containing pendant side chains containing sulfonyl groups which are attached to carbon atoms which have at least one fluorine atom attached thereto and the nonpermeable portion of the divider is fluorinated ethylene propylene or perfluoroalkoxy modified polytetrafluoroethylene.

7. In a monopolar chlor-alkali cell having a plurality of essentially vertically arranged parallel electrodes of one polarity extending downward into the cell with an essentially vertically arranged parallel electrode of opposite polarity extending upwardly within the cell between each adjacent pair of downwardly extending electrodes, the improvement comprising a divider separating the anolyte and catholyte chambers, said divider consisting in part of open-top boxlike means of impermeable, nonconductive material enveloping each downwardly extending electrode and having window-like openings therein of hydraulically impermeable membrane, said membrane windows being of a size and shape conforming to substantially the active electrode zones between said interacting electrodes and said membrane windows being positioned substantially directly between said interacting electrodes in said active electrode zones, each said open-top boxlike means being interconnected at their tops by a substantially horizontal hydraulically impermeable member which extends outwardly from the top of each boxlike means as to form a seal with the cell and adjacent boxlike means to completely separate the anolyte and catholyte chambers.

8. The electrolytic cell of claim 7 wherein the membrane portion of the divider between anolyte and catholyte chambers is a fluorinated polymer containing pendant side chains containing sulfonyl groups which are attached to carbon atoms which have at least one fluorine atom attached thereto and the nonpermeable portion of the divider is fluorinated ethylene propylene or perfluoroalkoxy modified polytetrafluoroethylene.

9. A method of making a cell divider for an electrolytic cell of the membrane type comprising heat sealing at a temperature of in excess of approximately 600° F. a membrane window to an impervious fluorinated ethylene propylene member which when in place in an operating cell divides the anolyte and catholyte chambers, said membrane window comprising a film of fluorinated polymer containing pendant side chains containing sulfonyl fluoride groups which are attached to carbon atoms which have at least one fluorine atom attached thereto, and, after heat sealing, saponifying said membrane with an alkali metal hydroxide, said membrane windows being of a size and shape conforming to substantially the active electrode zones of said interacting electrodes and said membrane windows being positioned substantially directly between said interacting electrodes in said active electrode zones.

10. A method as stated in claim 9 wherein the cathode facing surface of the membrane window is modified by contacting same with at least one compound selected from the group consisting of ammonia gas, amines, and polyamines after heat sealing is completed and before saponification is initiated.

* * * * *